United States Patent [19]

Thomas et al.

[11] Patent Number: 4,527,049

[45] Date of Patent: Jul. 2, 1985

[54] MICROPROCESSOR CONTROLLED ELECTRIC RANGE

[75] Inventors: Calvin J. Thomas, Orefield; William J. Day, Allentown, both of Pa.

[73] Assignee: Raytheon Company, Lexington, Mass.

[21] Appl. No.: 578,723

[22] Filed: Feb. 9, 1984

[51] Int. Cl.[3] ..... H05B 3/68

[52] U.S. Cl. ..... 219/449; 219/446; 219/451; 219/466; 374/111; 340/711

[58] Field of Search ..... 219/413, 445, 446, 447, 219/448, 449, 450, 451, 452, 453, 466; 126/39 BA; 340/711, 365 C, 803, 715; 374/111, 137, 167, 170

[56] References Cited

U.S. PATENT DOCUMENTS

| | | | |
|---|---|---|---|
| 3,612,826 | 10/1971 | Deaton | 219/453 |
| 3,886,539 | 5/1975 | Gould, Jr. | 340/711 |
| 4,324,138 | 4/1982 | Davis et al. | 374/111 |
| 4,341,197 | 7/1982 | Butts | 126/39 BA |
| 4,431,907 | 2/1984 | Barnett | 219/449 |
| 4,482,800 | 11/1984 | Schweig | 219/446 |

*Primary Examiner*—Volodymyr Y. Mayewsky
*Attorney, Agent, or Firm*—William R. Clark; Joseph D. Pannone

[57] ABSTRACT

A microprocessor controlled electric range having a solid state switch selectively associated with each surface heating element and a solid state switch in series and common to the circuits of each of the selectively associated switches. Each of the switches is controlled by a microprocessor and, if one of the selectively associated switches fails to a short circuit, the subsequent energization of all heating elements is disabled.

14 Claims, 4 Drawing Figures

SURFACE ELEMENT CONTROLS

MICROPROCESSOR
CONTROL PANEL
240V AC
-42V DC
-24V DC
40
22
44a
44b
44c
44d
42a
42b
42c
42d
46a
46b
46c
46d
47a
47b
47c
47d
48a
48b
48c
48d
12a
12b
12c
12d
49
50
51
52
54
56
58
60

MICROPROCESSOR CONTROLLED ELECTRIC RANGE

BACKGROUND OF THE INVENTION

In electric ranges, it has been common to connect a plurality of top surface heating element circuits to a source of AC power wherein each circuit comprises a relay in series between the source and a heating element. In response to the operator turning a control knob, a conventional surface heating element controller activates the appropriate relay to energize the selected heating element. Of course, a plurality of heating elements can be energized simultaneously.

A microprocessor-controlled electric range was developed. Added to each of the surface heating element circuits was a transistor which functioned as a switch to activate the relay. The switching function of each transistor was controlled by the microprocessor. More specifically, the base of each transistor was connected to the microprocessor and, in response to an operator input command to the microprocessor, it would bias the base of the appropriate transistor to render it conductive. As a result, −24 volts DC on the emitter side of the transistor was applied across the corresponding relay to ground. Accordingly, the relay was activated thereby closing the normally open contacts to energize the heating element. It was realized that if one of the transistors failed in a mode whereby it became a short circuit, the relay selectively associated with it would be inadvertently activated thereby energizing its respective heating element. In order to eliminate this potentially dangerous failure mode, a common transistor was put in series between each of the selectively associated transistors and the −24 volts DC. This common transistor was also controlled by the microprocessor and was switched to a conductive state by the microprocessor simultaneous to any one or more of the selectively associated transistors being closed. Accordingly, if one of the selectively associated transistors failed to a short circuit, its associated relay would not be activated because the common transistor still provided an open circuit between the −24 volts DC and ground.

SUMMARY OF THE INVENTION

In accordance with the teaching of the invention, it was recognized that the improved electric range as described in the Background herein still had a potentially dangerous failure mode. More specifically, even though a heating element would not be energized if its selectively associated transistor failed short because the common transistor was still open, the next time that the operator went to turn on another heating element thereby rendering the common transistor conductive, two heating elements would come on instead of one. Accordingly, it is an object of the present invention to prevent the inadvertent energizing of more heating elements than intended.

The invention defines an electric range comprising first and second electric heating elements, a first relay for controlling said first heating element, a second relay for controlling said second heating element, means for activating said first relay to energize said first heating element, said first relay activating means comprising a first switch in series with a second switch, means for activating the second relay to energize the second heating element, the second relay activating means comprising a third switch in series with the second switch, and means responsive to a short circuit failure in either the first switch or the third switch for preventing the first and second electric heating elements from being energized. The first, second and third switches may comprise solid state devices, or, more specifically, transistors. Also, a microprocessor can be used for controlling the solid state devices. It may be preferable that the preventing means comprise means for disabling the first and second relays. Stated differently, the invention may define two or more heating elements wherein a relay is associated with each heating element and each relay is connected through a selectively associated transistor switch and a common series transistor switch to a source of DC power which activates the relays. In accordance with the invention, means are provided for disabling the energization of any heating element upon the failure of any one of the selectively associated transistors in a short circuit mode. The disabling may define the common transistor switch being held in an open state wherein the relays cannot be provided with a sufficient DC pull-in voltage.

The invention also teaches an electric range comprising first and second electric heating elements, a first relay for controlling the first heating element, a second relay for controlling the second heating element, means for activating the first relay to energize the first heating element, the first relay activating means comprising a first switch in series with a second switch, means for activating the second relay to energize the second heating element, the second relay activating means comprising a third switch in series with the second switch, and means responsive to either the first or third switches being conductive while the second switch is nonconductive for preventing the first and second heating elements from being subsequently energized. The preventing means may preferably comprise means for disabling the first and second relays such as by locking the second switch in an open state.

The invention may also be practiced by an electric range comprising first and second electric heating elements, a source of alternating current, a first relay connected between the first heating element and the source alternating current, a second relay connected between the second heating element and the source of alternating current, a source of direct current for activating the first or second relays, first and second switches in series between the first relay and the source of direct current wherein, when both the first and second switches are closed, DC current flows through and activates the first relay thereby connecting the first heating element to the source of alternating current, a third switch in series with the second switch between the second relay and the source of direct current wherein, when both the second and third switches are closed, DC current flows through and activates the second relay thereby connecting the second heating element to the source of alternating current, and means responsive to either the first or third switches being conductive when the second switch is nonconductive for preventing the first or second heating elements from being connected to the source of alternating current. The first, second and third switches may each comprise a transistor and their switching functions may be controlled by a microprocessor.

The invention further defines a microprocessor-controlled electric range comprising first, second, third and fourth surface electric heating elements, a first switch for selectively energizing the first heating element, a second switch for selectively energizing the second heating element, a third switch for selectively energizing the third heating element, a fourth switch for selectively energizing the fourth heating element, a fifth switch in series with each of the first, second, third and fourth switches, an operator actuable control panel, a microprocessor comprising means responsive to an operator actuated input from the control panel for closing the first and fifth switches to energize the first heating element, for closing the second and fifth switches to energize the second heating element, for closing the third and fifth switches to energize the third heating element, and for closing the fourth and fifth switches to energize the fourth heating element, and means responsive to the first, second, third or fourth switches being conductive when the fifth switch is nonconductive for disabling the heating elements from being energized. Preferably, the switches may be transistors and the first, second, third and fourth relays, respectively, may be coupled between the first, second, third and fourth heating elements and the first, second, third and fourth switches.

BRIEF DESCRIPTION OF THE DRAWINGS

The foregoing and other objects and advantages of the invention will be more fully understood by reading the Description of the Preferred Embodiment with reference to the drawings wherein.

DESCRIPTION OF THE PREFERRED EMBODIMENT

Figure 1:
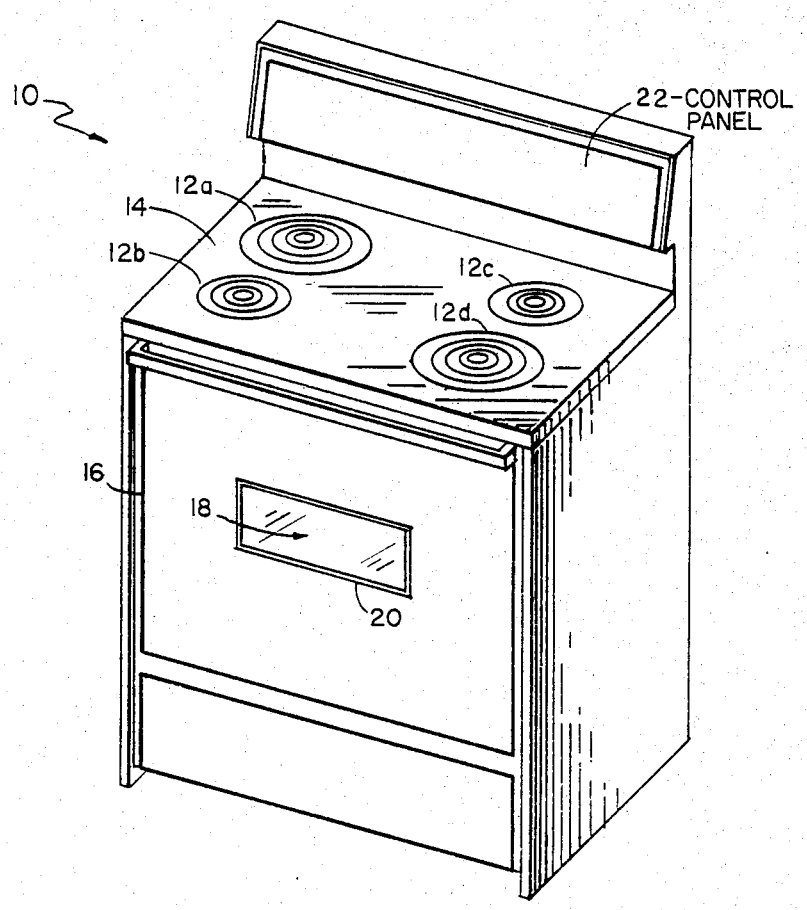
FIG. 1 is a microprocessor controlled electric range.

Referring to FIG. 1, there is shown a front perspective view of a microprocessor-controlled electric range 10 embodying the invention to advantage. Four conventional surface electric heating elements 12*a–d* are supported by horizontal top panel 14. Typically, heating elements 12*a–d* may have different sizes to accommodate different sized pots and pans. Located at the front of range 10 below top panel 14 is door 16 which provides access to oven 18 which can be viewed through door window 20. Control panel 22, a portion of which is shown in detail in FIG. 2, extends vertically upward from the rear of top panel 14. Many other conventional range components such as, for example, insulation, oven heating elements and sensors are preferably provided in a commercial range but are not shown as they form no part of the invention.

Figure 2:
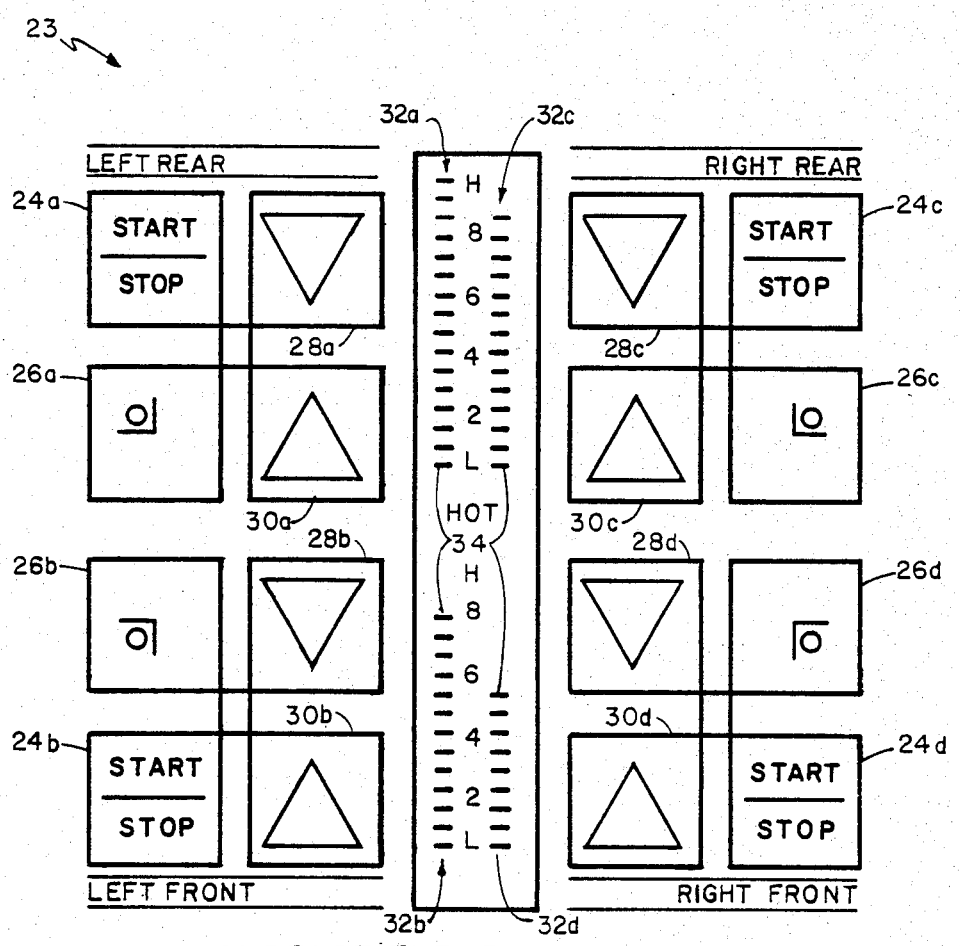
FIG. 2 is a view of the surface heating element control section of the control panel.

Referring to FIG. 2, there is shown the surface electric heating element control section 23 of control panel 22. Typically, control panel 22 would include other control sections such as, for example, the keyboard and display for oven 18 but such other sections are not shown as they are not necessary for an understanding of the invention. START/STOP touch pads 24*a–d* are on/off controls for the energization of the left rear, left front, right rear, and right front heating elements 12*a–d*, respectively. Nonfunctional designators 26*a–d* indicate the correspondence between controls and the respective heating elements 12*a–d*. DOWN ARROW touch pads 28*a–d* decrease and UP ARROW touch pads 30*a–d* increase the temperature settings of the respective heating elements 12*a–d*. Display 32*a–d* illuminate when their respective heating elements 12*a–d* are energized and indicate the temperature setting of the heating elements. Specifically, each display of displays 32*a–d* defines a plurality of vertically-aligned indicator lights 34 which are positioned parallel to a scale which ascends from low "L" to high "H" with incremental numerals in between. Once a START/STOP touch pad 24*a–d* is pressed thereby energizing its respective heating element 12*a–d*, indicator lights 34 for that heating element will illuminate and blink for a few seconds to call the present temperature setting to the attention of the operator so that, if desired, it can be altered using touch pads 28*a–d* or 30*a–d*. DOWN ARROW touch pads 28*a–d* and UP ARROW touch pads 30*a–d* can also be used to turn on respective heating elements 12*a–d*. If a DOWN ARROW touch pad 28*a–d* is used, the respective heating element 12*a–d* will come on at the highest possible temperature setting, and that setting will be incrementally decreased until the pad is released. If the UP ARROW touch pad 30*a–d* is used, the respective heating element 12*a–d* will come on at the lowest possible temperature setting, and that setting will be incrementally increased until the pad is released. The temperature settings can also be changed by tapping touch pads 28*a–d* or 30*a–d* rather than holding them down; in such case, each tap corresponds to the increment of one of the light indicators 34. Typically, touch pads 24*a–d*, 28*a–d* and 30*a–d* may be membrane or capacitive switches which provide control inputs to microprocessor 40.

Figure 3:
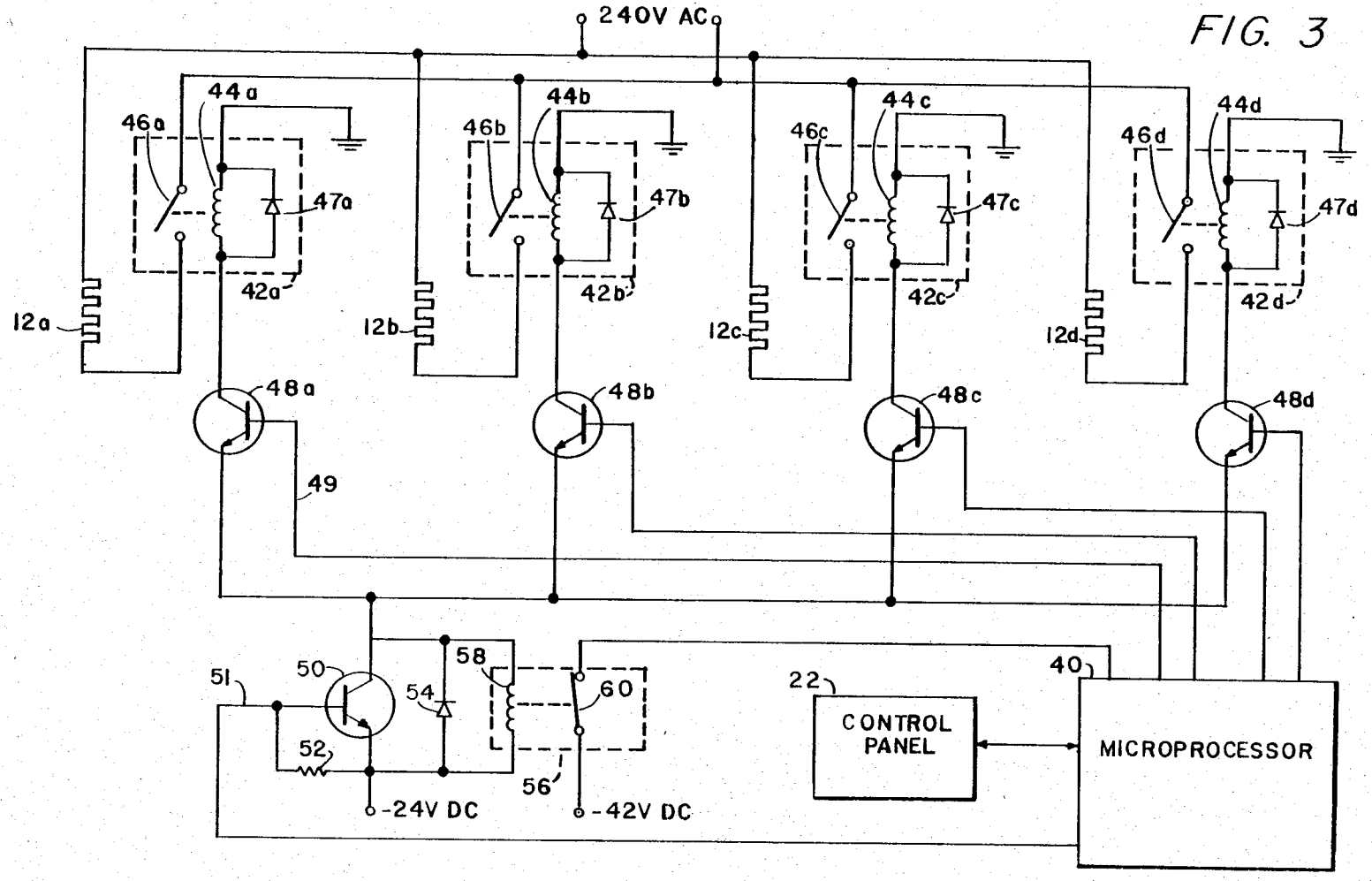
FIG. 3 is a circuit diagram of the control for the electric range of FIG. 1.

Referring to FIG. 3, a schematic diagram of the control circuit for range 10 is shown. Generally, microprocessor 40 or microcomputer is a control processor which performs the functions described herein. Microprocessor 40 may be a general purpose processor that is programmed to perform the described functions or it may be a customized integrated circuit that is specifically designed and programmed according to well-known principles for the application described herein. In accordance with the invention, microprocessor 40 provides control for the surface electric heating elements 12*a–d*. It may be desirable that range 10 also provide other microprocessor control functions such as, for example, the control of oven 18 and monitoring of interlocks. These other desirable functions can be provided by a separate microprocessor or integrated into the design of microprocessor 40.

Because the control circuits of heating elements 12*a–d* are identical, only the control circuit for heating element 12*a* will be described and it is understood that the control circuits for heating elements 12*b–d* operate in the same manner. Heating element 12*a* is energized by activating or closing relay 42*a*. Specifically, sufficient current passing through coil 44*a* causes normally opened contacts 46*a* to close thereby providing 240 volts AC across heating element 12*a*. DC blocking diode 47*a* is connected across coil 44*a*. Solid state devices, here transistors 48*a* and 50, are in series between relay 42*a* and −24 volts DC which is used to provide the current to close relay 42*a*. Transistors 48*a* and 50 function as switches with their respective base biases being controlled by microprocessor 40 on lines 49 and 51, respectively. Accordingly, to energize heating element 12*a*, the operator would press START/STOP pad 24*a*, DOWN ARROW pad 28*a* or UP ARROW pad 30*a* of the surface element control section 23 of control panel 22 thereby providing an input signal to microprocessor 40. In response thereto, microprocessor 40 renders transistors 48*a* and 50 conductive so that −24 volts DC is provided across coil 44*a* of relay 42*a*. If the temperature setting is less than high "H" as determined by touch pads 28*a* and 30*a* and as indicated by display 32*a*, microprocessor 40 reduces the duty cycle of heating element 12*a* accordingly.

As can be seen in FIG. 3, switch or transistor 50 is also common to the control circuits of heating elements 12*b–d*. More specifically, transistor 50 is also in series with transistors 48*b–d* which are selectively associated with the relays 42*b–d* of heating elements 12*b–d*. Accordingly, transistor 50 functions as a common safety switch so that if any transistor of transistors 48*a–d* fail to a state such that it becomes a short circuit, the associated heating element of heating elements 12*a–d* would not be energized by −24 volts DC being applied across its respective relay 42*a–d*. Stated differently, transistor 50 is a redundant switch placed in series with control circuits of each heating element for the sole purpose of preventing that heating element from being energized by a short circuit failure of its selectively associated switch or transistor 48*a–d*. Resistor 52 here 4.7K ohms is connected between the base and emitter of transistor 50 and DC blocking diode 54 is connected between the collector and emitter.

In accordance with the teachings of the invention, normally closed relay 56 is connected in parallel with transistor 50 or, more specifically, across its collector and emitter. In normal operation, −42 volts DC from the power supply of range 10 is provided through normally closed contacts 60 of relay 56 to microprocessor 40. This −42 volts DC provides the power to microprocessor 40 for energizing the surface heating element control functions. If the −42 volts DC is removed from microprocessor 40, the closing of switches 48*a–d* and 50 is disabled. In the event of a short circuit failure of any one of transistors 48*a–d* such that it is conductive while transistor 50 is nonconductive, −24 volts DC is applied across the series of coil 58 and the relay coil of coils 44*a–d* that is selectively associated with the failed transistor. Accordingly, using transistor 48*a* as an example of the failed transistor, current flows through coil 58 and the relay coil 44*a*. The minimum pull-in voltage for relay 42*a* and the other relays 42*b–d* is on the order of 10–11 volts. Without this pull-in voltage, there is not enough current flow through coil 44*a* to close normally open contacts 46*a* thereby energizing heating element 12*a*. The impedance of each coil 44*a* is approximately 470 ohms while the minimum impedance of coil 58 is approximately 2200 ohms. Accordingly, when coil 58 is in series with coil 44*a*, there is not enough voltage across coil 44*a* to close its associated normally open contacts 46*a*. Stated differently, when coil 58 is in series with any coil of coils 44*a–d*, there is not enough current flowing between ground and −24 volts DC to activate the respective relay of relays 42*a–d*. Relay 56, however, is selected such that when it is in series with a coil of coils 44*a–d* between ground and −24 volts DC, there is enough voltage across it and current through it to activate normally closed contacts 60 to open thereby interrupting −42 volts DC from the power supply to microprocessor 40. Those skilled in the art will recognize that relays 42*a–d* and 56 could be different than described herein but, what is important is that when relay 56 is in series with one of relays 42*a–d*, relay 56 is activated but the relay of relays 42*a–d* is not. When microprocessor 40 is deactivated or disabled by the opening of normally closed contacts 60 and the interruption of −42 volts DC, it can no longer provide biasing signals for transistors 48*a–d* and 50 to energize surface heating elements 12*a–d*. For example, none of the heating elements 12*a–d* can then be turned on because, among other reasons, transistor 50 is not be biased to a conductive state and that means that selectively associated relays 42*a–d* are in series with relay 56 which has an impedance that prohibits the activation of relays 42*a–d*. In accordance with the teachings of the invention, it is important that the control circuit for the surface elements 12*a–d* be disabled when one or more of transistors 48*a–d* fail in a short circuit state because even though a surface element 12*a–d* could not energize without transistor 50 being rendered conductive, the next time the operator turned on another heating element 12*a–d*, transistor 50 would be rendered conductive and the heating element selectively associated with the failed transistor would also be energized because the transistor would still be shorted. As a result, a safety hazard would be created because two heating elements would be energized when only one was intended. Accordingly, it is desirable to have the whole control circuit disabled until the failed transistor is replaced.

Heretofore, a circuit has been described which disables the energization of all heating elements 12*a–d* if any one of transistors 48*a–d* fails in a short circuit. More specifically, the normal mode of operation is that transistor 50 is conductive any time one or more of transistors 48*a–d* is conductive. Stated differently, any time one or more of transistors 48*a–d* is conductive, transistor 50 is also conductive so that coil 58 is not in series with any one of coils 44*a–d* between ground and −24 volts DC. Once the mode of disablement is entered by switch or transistor 50 being open or nonconductive when one of the switches or transistors 48*a–d* is closed or conductive, the surface heating element control remains disabled until the shorted transistor 48*a–d* is replaced. Accordingly, in normal operation, it is important that any time microprocessor 40 biases one of transistors 48*a–d*, it first bias transistor 50 or bias them both simultaneously. Further, when START/STOP touch pad 24*a–d* is pressed to deenergize a heating element 12*a–d*, microprocessor 40 should first remove the bias from transistor 48*a–d* and then remove the bias from transistor 50. Those skilled in the art will recognize that the switches 48*a–d* and 50 can be turned off approximately simultaneously because it would take a small increment of time for the current to build up in coil 58 to open normally closed contacts 60.

Even though the control for all of the surface heating elements 12*a–d* is disabled by the failure of one or more transistors 48*a–d* in a short circuit state, it may be preferable that the oven 18 continue to be operable. If the control for oven 18 is provided by a separate microprocessor other than microprocessor 40, that other microprocessor would continue to function even though the −42 volts DC to microprocessor 40 is interrupted. If both the oven 18 and the surface heating elements 12*a–d* are controlled by the same microprocessor, it may be preferable that the interruption of −42 volts DC through normally closed contacts 60 only disable the surface heating element functions.

Figure 4:
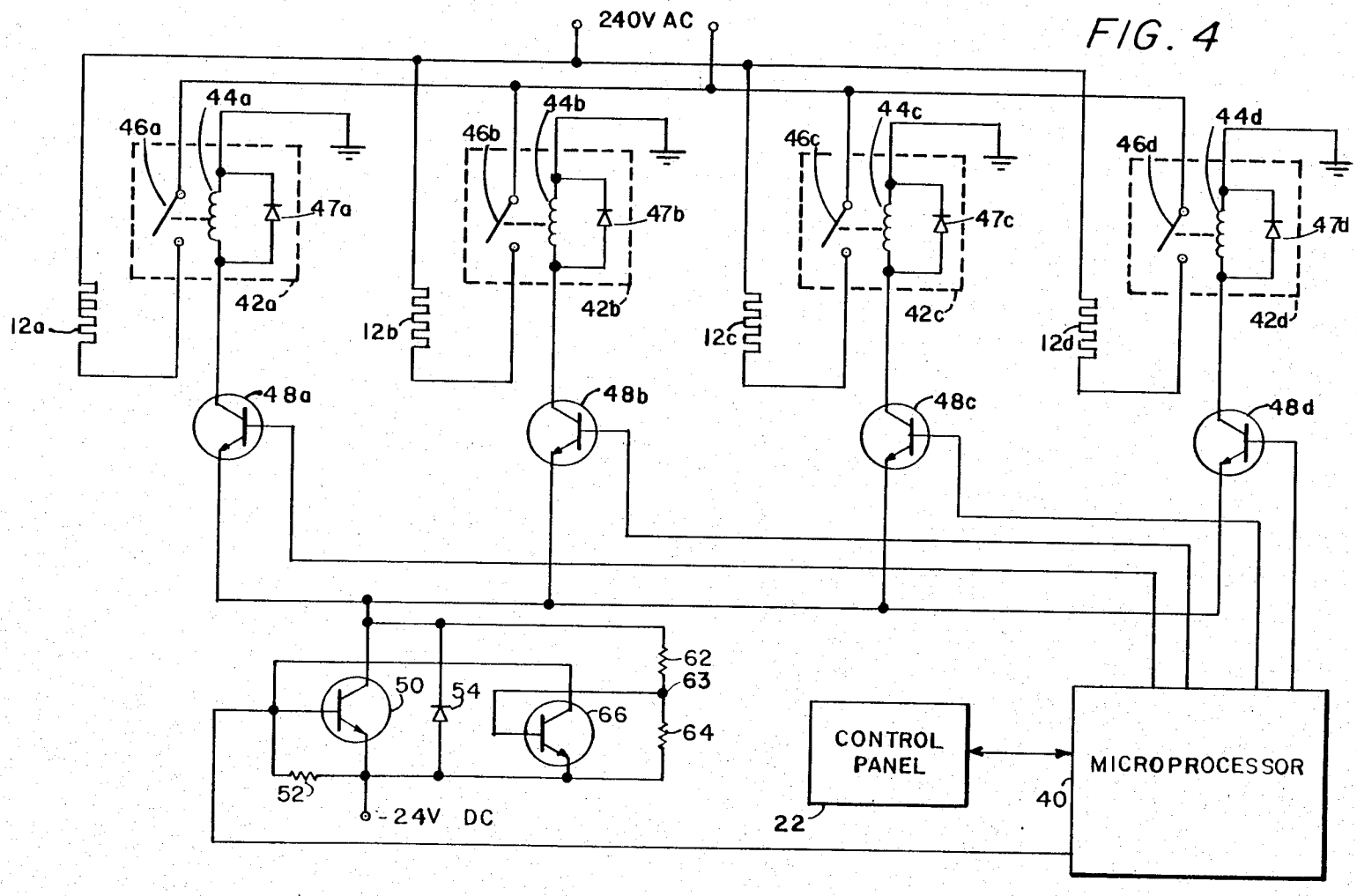
FIG. 4 is an alternate embodiment of the circuit diagram of FIG. 3.

Referring to FIG. 4, an alternate embodiment of FIG. 3 is shown. Heating elements 12*a–d*, relays 42*a–d*, transistors 48*a–d*, transistor 50, resistor 52 and diode 54 are the same and provide the same functions as described with reference to those parts in FIG. 3. In the event that any of transistors 48*a–d* such as, transistor 48*a*, fails to a short circuit state and transistor 50 is open or opens, −24 volts DC is applied across the series of coil 44*a*, resistor 62 and resistor 64. The impedance of coil 44*a*, here approximately 470 ohms, is small with respect to resistors 62 and 64 which may typically be approximately 150K ohms. Accordingly, similar to the operation described with reference to FIG. 3, substantially less than the required pull-in voltage appears across coil 44*a* and, therefore, relay 42*a* is not activated. The junction 63 between resistors 62 and 64 is connected to the base of transistor 66 which turns on and shorts out transistor 50 preventing it from coming on. More specifically, when transistor 66 turns on, it clamps the base and the emitter of transistor 50 to the same potential thus disabling its switching function by preventing the required approximately 1.2 volts from appearing across the base/emitter junction. As a result, all of the heating elements 12*a–d* are disabled until the failed transistor, here transistor 48*a*, is replaced.

Many alterations and modifications are possible to the description of the preferred embodiments without departing from the spirit and scope of the invention. Accordingly, it is intended that the scope of the invention be limited only by the appended claims.

What is claimed is:

1. An electric range comprising:

first and second electric heating elements;

a first relay for controlling said first heating element;

a second relay for controlling said second heating element;

means for activating said first relay to energize said first heating element, said first relay activating means comprising a first switch in series with a second switch;

means for activating said second relay to energize said second heating element, said second relay activating means comprising a third switch in series with said second switch; and means responsive to a short circuit failure in either said first switch or said third switch for preventing said first and second electric heating elements from being energized.

2. The range recited in claim 1 wherein said first, second and third switches each comprise a solid state device.

3. The range recited in claim 1 wherein said first, second and third switches each comprise a transistor.

4. The range recited in claim 2 further comprising a microprocessor for controlling said solid state devices.

5. The range recited in claim 1 wherein said preventing means comprises means for disabling said first and second relays.

6. An electric range comprising:

first and second electric heating elements;

a first relay for controlling said first heating element;

a second relay for controlling said second heating element;

means for activating said first relay to energize said first heating element, said first relay activating means comprising a first switch in series with a second switch;

means for activating said second relay to energize said second heating element, said second relay activating means comprising a third switch in series with said second switch; and means responsive to either said first or third switches being conductive while said second switch is nonconductive for preventing said first and second heating elements from being subsequently energized.

7. The range recited in claim 6 wherein said preventing means comprises means for disabling said first and second relays.

8. An electric range comprising:

first and second electric heating elements;

a source of alternating current;

a first relay connected between said first heating element and said source of alternating current;

a second relay connected between said second heating element and said source of alternating current;

a source of direct current for activating said first or second relays;

first and second switches in series between said first relay and said source of direct current wherein, when both said first and second switches are closed, DC current flows through and activates said first relay thereby connecting said first heating element to said source of alternating current;

a third switch in series with said second switch between said second relay and said source of direct current wherein, when both said second and third switches are closed, DC current flows through and activates said second relay thereby connecting said second heating element to said source of alternating current; and means responsive to either said first or third switches being conductive when said second switch is nonconductive for preventing said first or second heating elements from being connected to said source of alternating current.

9. The range recited in claim 8 wherein said first, second and third switches each comprise a transistor.

10. The range recited in claim 9 further comprising a microprocessor for controlling the conductivity of said transistors.

11. The range recited in claim 8 wherein said preventing means comprises means for disabling said first and second relays.

12. A microprocessor-controlled electric range comprising:

first, second, third and fourth surface electric heating elements;

a first switch for selectively energizing said first heating element;

a second switch for selectively energizing said second heating element;

a third switch for selectively energizing said third heating element;

a fourth switch for selectively energizing said fourth heating element;

a fifth switch in series with each of said first, second, third and fourth switches;

an operator actuable control panel;

a microprocessor comprising means responsive to an operator actuated input from said control panel for closing said first and fifth switches to energize said first heating element, for closing said second and fifth switches to energize said second heating element, for closing said third and fifth switches to energize said third heating element, and for closing said fourth and fifth switches to energize said fourth heating element; and means responsive to said first, second, third or fourth switches being conductive when said fifth switch is nonconductive for disabling said heating elements from being energized.

13. The range recited in claim 12 further comprsing first, second, third and fourth relays respectively coupled between said first, second, third and fourth heating elements and said first, second, third and fourth switches.

14. The range recited in claim 12 wherein each of said switches comprises a transistor.

* * * * *